US005826401A

United States Patent [19]

Bois

[11] Patent Number: 5,826,401

[45] Date of Patent: Oct. 27, 1998

[54] MACHINE AND A METHOD FOR AUTOMATICALLY FORMING, FILLING, AND CLOSING BAGS

[75] Inventor: Henri Bois, Neuilly-sur-Seine, France

[73] Assignee: Flexico-France, Henonville, France

[21] Appl. No.: 806,377

[22] Filed: Feb. 27, 1997

[30] Foreign Application Priority Data

Feb. 27, 1996 [FR] France ..... 96 02389

[51] Int. Cl.[6] ..... B65B 61/18; B65B 9/08

[52] U.S. Cl. ..... 53/412; 53/133.4; 53/139.2; 53/551; 53/451

[58] Field of Search ..... 53/412, 133, 4, 53/139.2, 550, 551, 552, 553, 554; 493/213, 927

[56] References Cited

U.S. PATENT DOCUMENTS

| | | | |
|---|---|---|---|
| 2,294,220 | 8/1942 | Albertson | 53/551 X |
| 2,390,071 | 12/1945 | Barnett | 53/551 X |
| 3,234,705 | 2/1966 | Schwartz | 53/553 X |
| 3,599,387 | 8/1971 | James | 53/551 X |
| 3,785,112 | 1/1974 | Leasure et al. | 53/551 X |
| 3,844,090 | 10/1974 | Pepmeier | 53/551 |
| 4,534,752 | 8/1985 | Ferrell et al. | 493/213 |
| 4,617,683 | 10/1986 | Christoff . | |
| 4,655,862 | 4/1987 | Christoff et al. . | |
| 4,666,536 | 5/1987 | Van Erden et al. . | |
| 4,701,361 | 10/1987 | van Erden . | |
| 4,709,398 | 11/1987 | Ausnit . | |
| 4,844,759 | 7/1989 | Boeckmann . | |
| 4,878,987 | 11/1989 | ven Erden . | |
| 4,894,975 | 1/1990 | Ausnit . | |
| 4,909,017 | 3/1990 | McMahon et al. . | |
| 4,929,225 | 5/1990 | Ausnit et al. . | |
| 5,072,571 | 12/1991 | Boeckmann | 53/139.2 X |
| 5,111,643 | 5/1992 | Hobock . | |
| 5,254,073 | 10/1993 | Richison et al. | 493/213 X |
| 5,255,497 | 10/1993 | Zoromoski et al. | 53/551 |
| 5,400,565 | 3/1995 | Terminella et al. . | |

FOREIGN PATENT DOCUMENTS

| | | | |
|---|---|---|---|
| 2068628 | 12/1992 | Canada | 53/139.2 |
| 0 276 554 | 12/1987 | European Pat. Off. . | |
| 2 102 442 | 3/1972 | France . | |
| WO 89/00949 | 2/1989 | WIPO . | |

*Primary Examiner*—Linda Johnson
*Attorney, Agent, or Firm*—Schwartz & Weinrieb

[57] ABSTRACT

The present invention relates to a machine for automatically forming, filling, and closing bags made from a flexible film. The machine includes means suitable for generating at least one fold associated with the film that is to constitute a bag, so as to form at least one gusset in the final bag. The invention also relates to a method of manufacturing such bags.

58 Claims, 14 Drawing Sheets

MACHINE AND A METHOD FOR AUTOMATICALLY FORMING, FILLING, AND CLOSING BAGS

FIELD OF THE INVENTION

The present invention relates to machines for automatically forming, filling, and closing packages made of film, in particular of thermoplastic material, and including closure ribs, for example complementary male and female closure ribs.

BACKGROUND OF THE INVENTION

Machines of the afore-noted type are often known as "Form, Fill, and Seal machines" or FFS machines.

Numerous machines of this type have already been proposed.

Most such machines comprise: a former which is fed with film in the planar state from a pay-out spool and which delivers the film shaped as a tube; a filler chute opening into the former and consequently into the tube; longitudinal sealing means for closing the tube longitudinally; and means for sequentially generating a first transverse line of sealing before any product is put into the tube by means of the filling chute, and a second transverse sealing line product has been deposited into the tube, so as to close or form a package around the product.

OBJECTS AND SUMMARY OF THE INVENTION

The present invention seeks to improve such known machines.

In the context of the present invention, there is proposed a machine for automatically forming, filling, and closing bags, the machine including means for generating at least one fold associated with the film that is to constitute the bag, so as to form at least one gusset in the final bag.

In various implementations, the above-mentioned fold can be longitudinal, that is parallel to the travel direction of the film, or it can be transverse, that is perpendicular to the film travel direction.

According to an advantageous characteristic of the invention, the machine further includes fixing means suitable, prior to the bags being formed, for defining localized zones for securing one of the above-mentioned folds at locations that preferably correspond to transverse sealing lines.

In a first embodiment, at least one longitudinal transversely extending fold is provided to form a gusset in the bottom of the bag, in which case the fold is formed in a region remote from the mouth that receives the closure assembly.

In a second embodiment, two longitudinal transverse folds are provided, to form lateral gussets in the bag, extending transversely relative to the closure ribs.

In a first variant embodiment of the invention, the longitudinal transverse fold is made in the form of a Z-shaped fold in the body of the film.

In a second variant embodiment of the present invention, the longitudinal or transverse fold is made by adding a folded strip to the film, for example corresponding to the desired bottom gusset.

The present invention also provides a method of manufacturing bags using a machine for automatically forming, filling, and closing bags, which method includes the step of generating at least one fold associated with the film that is to constitute a bag, so as to form at least one gusset in the final bag.

According to another advantageous characteristic of the invention, the method further includes the step which consists, prior to the bags being formed, in defining localized zones for securing the above-mentioned fold at locations that preferably correspond to the transverse sealing lines.

In a first variant of the method of the invention, the fold-generating step consists in forming a Z-shaped fold in the body of the film.

In a second variant of the method of the present invention, the fold-generating step consists in making the fold by adding a longitudinally-folded strip to a film, for example corresponding to the bottom gusset.

BRIEF DESCRIPTION OF THE DRAWINGS

Other characteristics, objects, and advantages of the present invention will become apparent upon reading the following detailed description with reference to the accompanying drawings given as non-limiting examples, in which like reference characters designate like or corresponding parts throughout the several views, and wherein.

DETAILED DESCRIPTION OF THE ILLUSTRATED EMBODIMENTS

Figure 1:
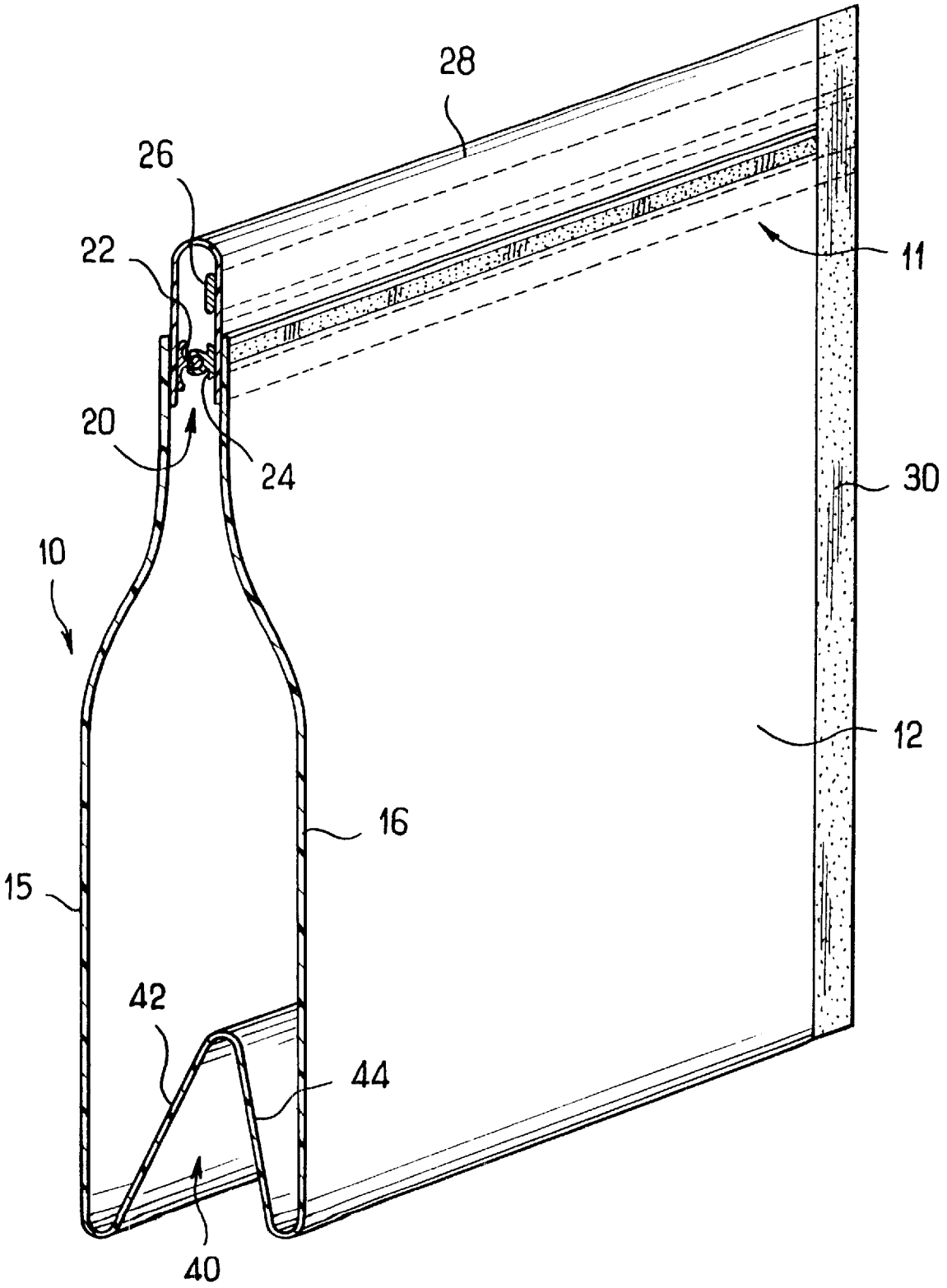
FIG. 1 is a diagrammatic perspective and cross-section view of a bag of the present invention, made using a film that is simple.

In the description below, the embodiments initially described all make use of bags including bottom gussets, thereby simplifying description. However, as mentioned above, the invention is not limited to gussets in that position. In particular, in a variant, the invention can apply to making bags having pairs of lateral gussets.

Also, the description begins with variant implementations in which the fold made in the film is a longitudinal fold, that is parallel to the film travel direction. Thereafter, other variants are described in which the fold is made transversely relative to the film travel direction.

In the accompanying figures, there can be seen a bag 10 formed from a film 12. The film is preferably thermoplastic. However, the invention can be extended to any flexible film capable of constituting a bag. The bag 10 includes a closure assembly 20 formed by two complementary closure ribs 22 and 24, that is a male rib and a female rib, respectively that are fixed on the inside surfaces of the bag 10, at the mouth 11 thereof. The ribs 22 and 24 extend longitudinally in the first embodiments, along the film 12 that is being processed to manufacture a bag. The bag is closed transversely (that is perpendicularly to the ribs 22 and 24) by heat sealing lines 30.

In the first embodiments of the present invention, the bag 10 is provided with a gusset 40 in its bottom remote from its mouth 11.

In the figures, the gusset 40 is made up of two facets 42 and 44 which together form a tuck inside the bag, having a concave face looking towards the outside.

Numerous configurations are possible for the ribs 22 and 24. By way of example, they may be integrally molded with the film 12, or they may be added thereto. For this purpose, the ribs 22 and 24 may be carried by respective strips 23 and 25 as shown in particular in FIGS. 3 and 4, or they may be carried by a single strip 28 that is folded into a U-shape, as shown in particular in FIG. 1.

Such strips 23, 25, 28 may be fixed to the inside surface of the film 12 (or to the outside surface for the strip 28) by any appropriate means, preferably by heat sealing.

As can be seen in particular in FIG. 1, the closure assembly 20 may be provided in a conventional manner with a longitudinal rip-cord 26 so as to facilitate opening the bag.

Figure 4A:
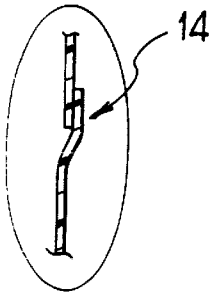
FIGS. 3, 4, 5, and 6 are cross-section views of bags constituting other variants of the invention, with FIGS. 3*a* and 4*a* showing implementation details of longitudinal lines of sealing.
Figure 4:
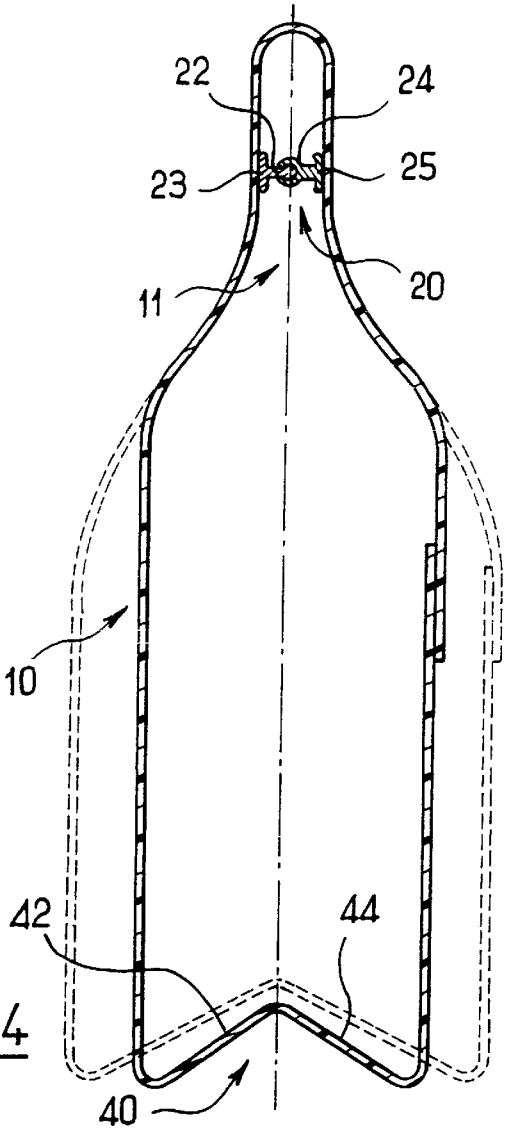
Figure 3A:
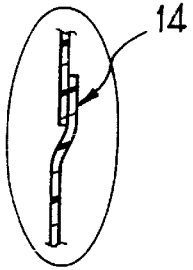
Figure 3:
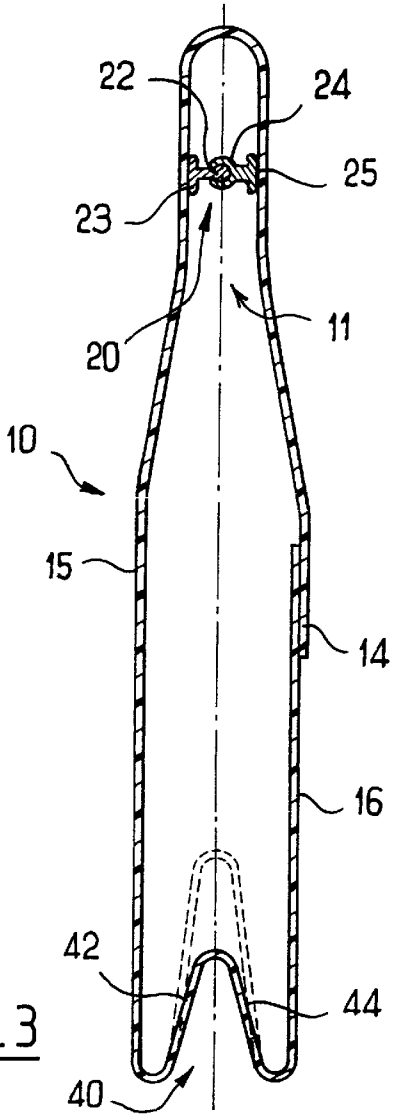

The bag 10 may be closed longitudinally by the strip 28 carrying the ribs 22 and 24 as shown in FIG. 1, or by a longitudinal sealing line 14, as shown in FIGS. 3 and 4, for example.

Figure 6:
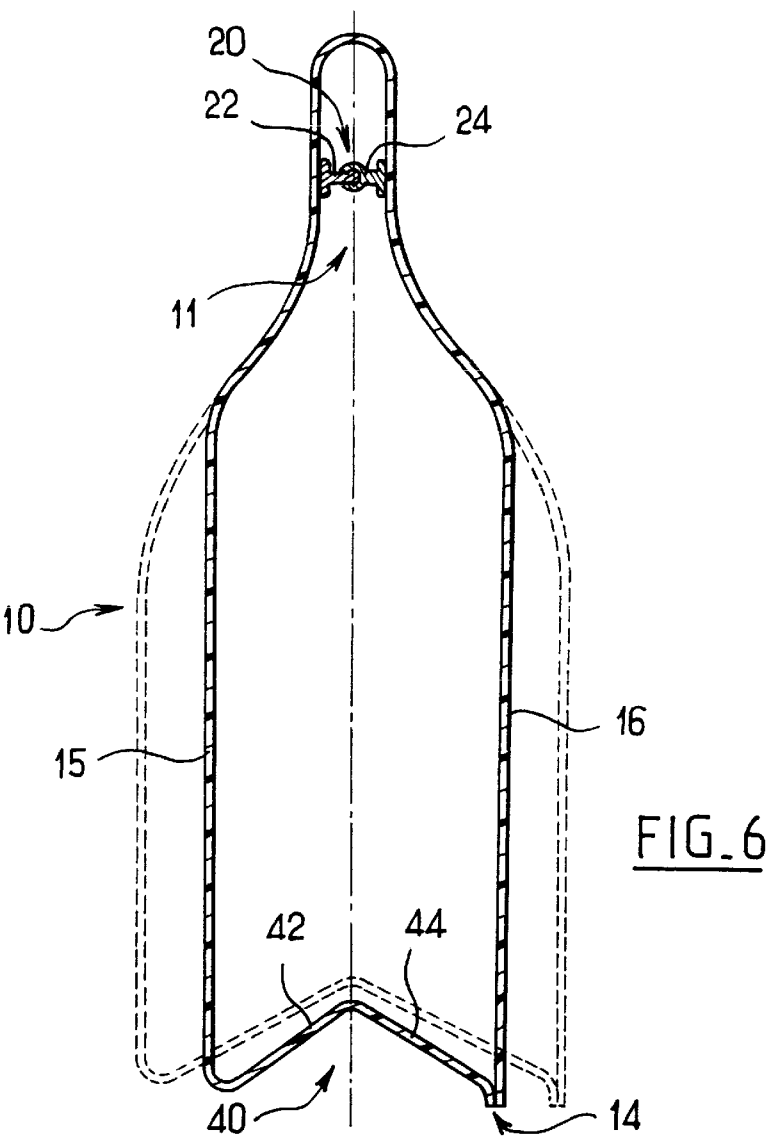
Figure 5:
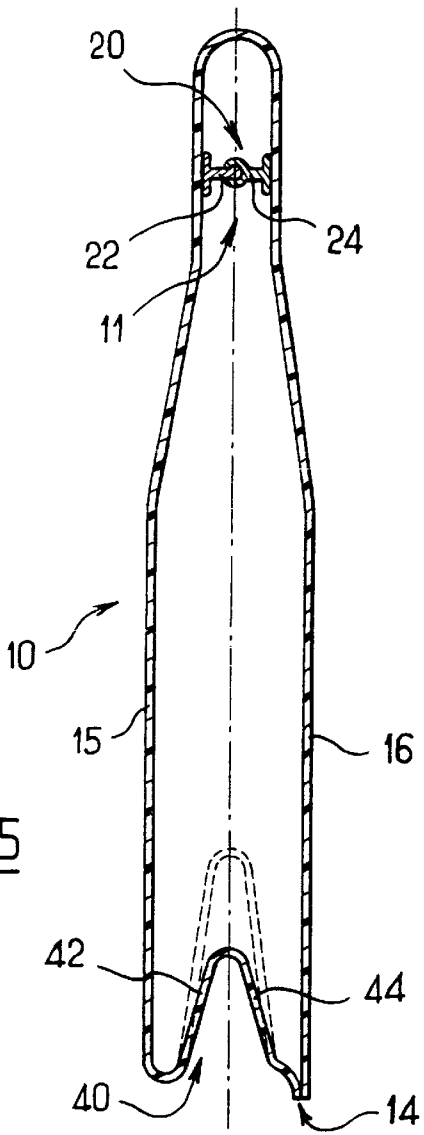

The longitudinal sealing line 14 may be formed at various different locations on the bag 10, for example along the width of its side walls 15, 16 in the body of the bag 10, as shown in FIGS. 3 and 4, or in the zone where a side wall 16 joins the bottom gusset 40, as shown in FIGS. 5 and 6.

The overlap of the two margins of the film 12 at the longitudinal sealing line 14 can be right-handed or left-handed, as contrasted by FIGS. 3, 4 when compared with FIGS. 3*a*, 4*a*.

Figure 2:
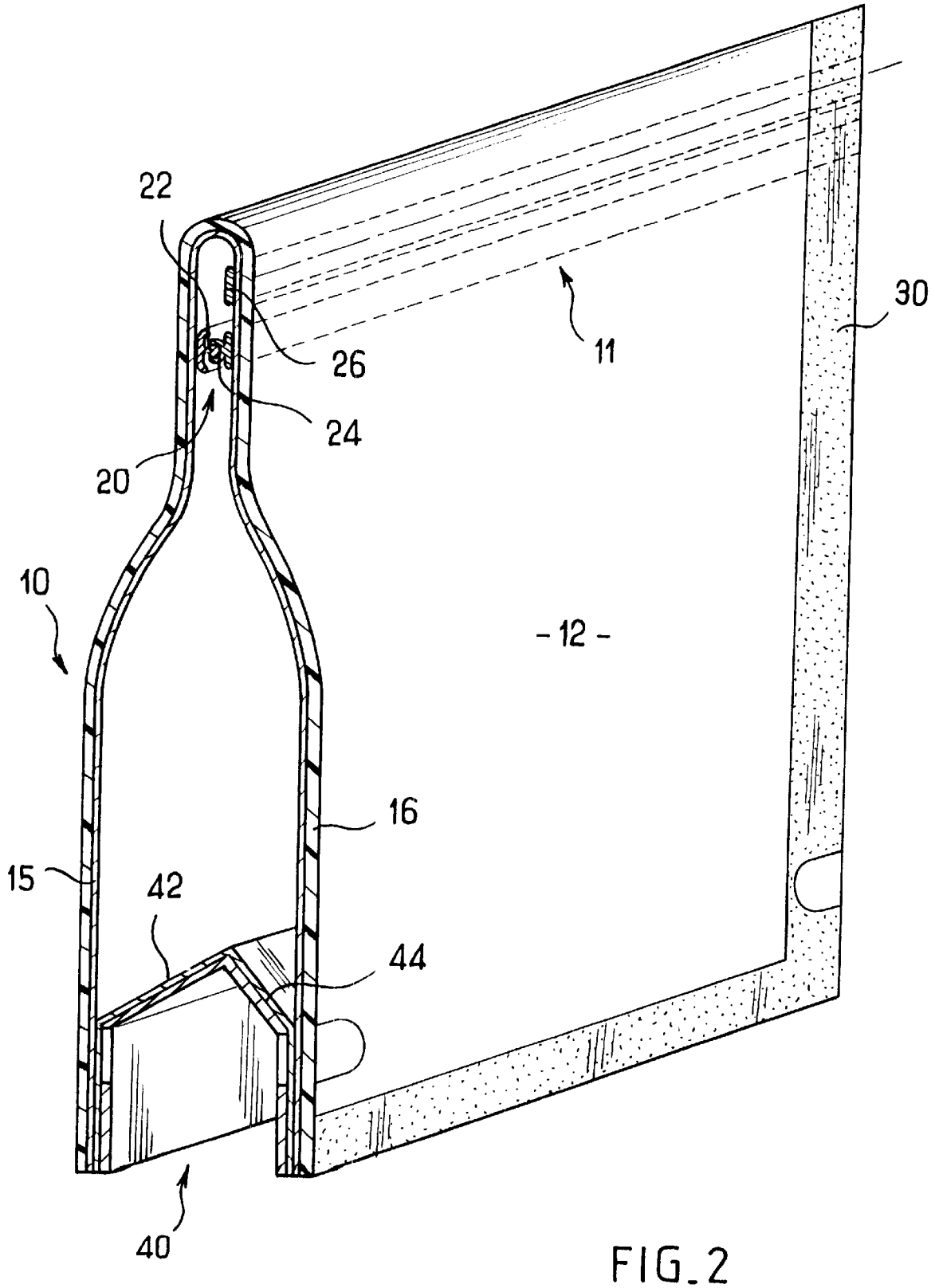
FIG. 2 is a diagrammatic perspective and cross-section view of a bag constituting another variant embodiment of the present invention made using a film that is a composite.

The film 12 may be a simple single-layer flexible film as shown in FIG. 1, or it may be a composite film made up of a plurality of adjacent layers, for example by coextrusion, as shown in FIG. 2.

Figure 7:
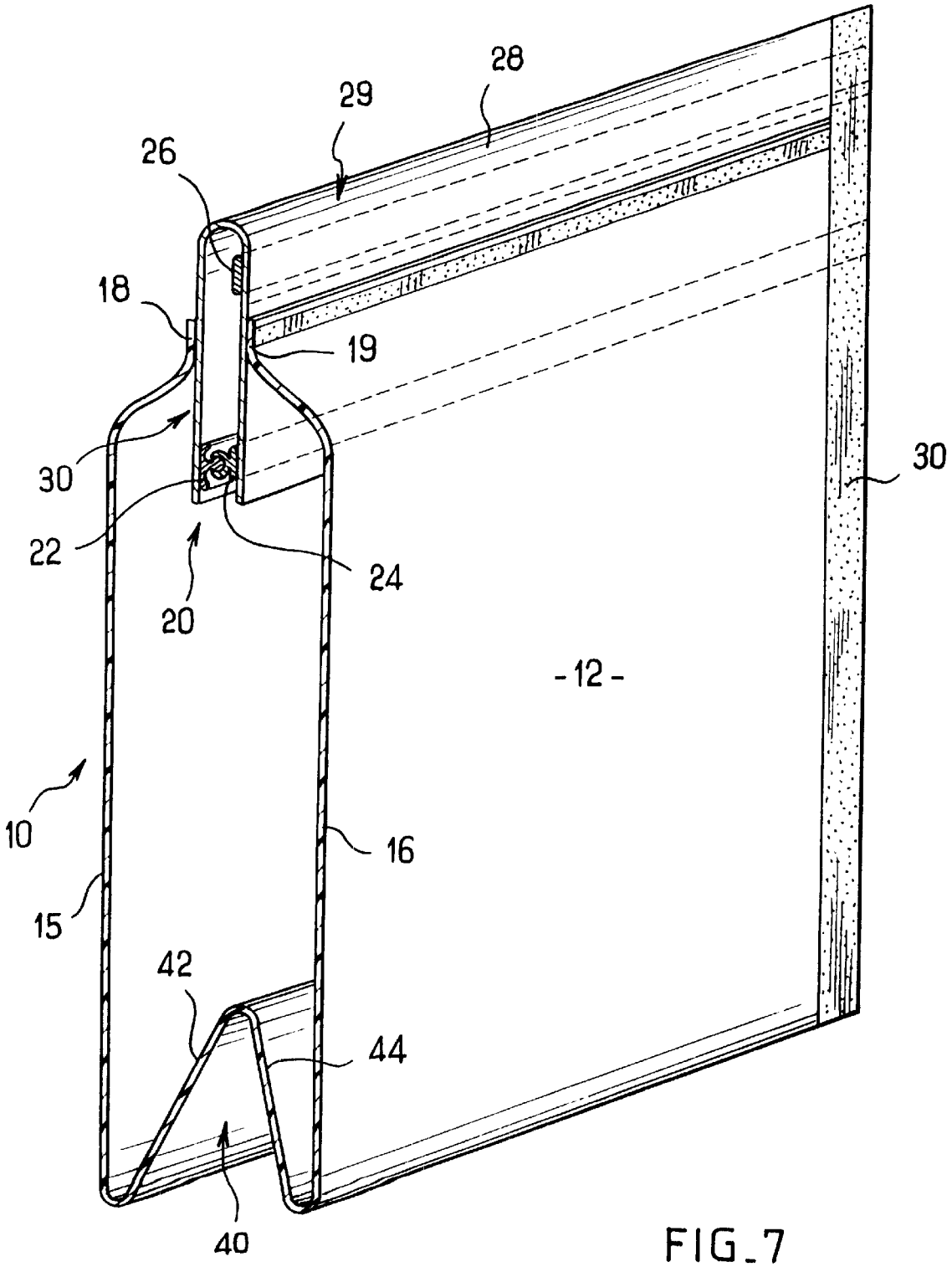
FIG. 7 is a diagrammatic perspective and cross-section view of a bag constituting another variant embodiment of the present invention, obtained using a closure assembly including a U-shaped support strip.

In a preferred embodiment shown in FIG. 7, the U-shaped strip 28 supporting the ribs 22 and 24 is heat-sealed halfway across its width to the margins 18 and 19 of the film 12. There are thus formed both an outer, first sheet portion 29 constituted by the web of the U-shaped strip 28 and an inner, second sheet portion 30 supporting the ribs 22 and 24. This prevents pressure inside the bag from stressing the ribs 22 and 24 so as to open the same, because the rib support is not connected to the margins 18 and 19 of the film 20 level with the ribs 22, 24, but at a point that is offset therefrom. This effect can be reinforced and even guaranteed by ensuring that the inner, second sheet portion 30 carrying the ribs 22 and 24 is of a longer dimension than that of the outer sheet 29, as shown in FIG. 7.

Figure 8:
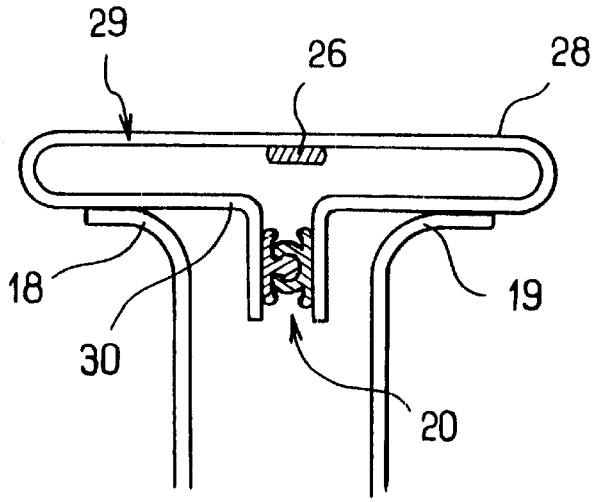
FIG. 8 is a detail view of the closure assembly of FIG. 7, and FIGS. 8*a* and 8*b* show two variants of the closure assembly.

FIGS. 7 and 8 show a variant in which the U-shaped strip 28 is fixed to the inside surfaces of the margins 18 and 19 of the film 12. In a variant, as shown in FIG. 8*a*, the U-shaped strip 28 can be fixed to the outside surfaces of the margins 18 and 19 of the film 12.

Figure 8A:
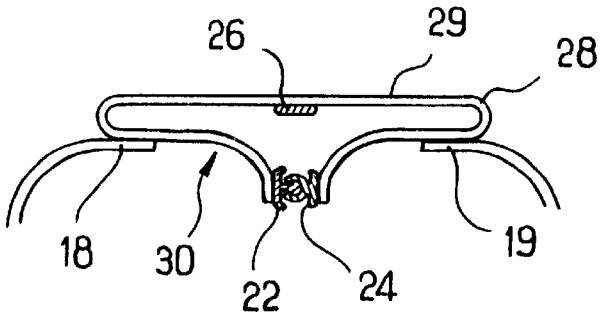

Also, as shown in FIGS. 7, 8, and 8*a*, the U-shaped strip 28 is fixed to the margins 18 and 19 of the film 12 by means of zones of the strip 28 lying between the ribs 22, 24 and the center of the strip 28 which may be provided with a rip-cord 26, for example. However, in a variant, as shown in FIG. 8*b*, the U-shaped strip 28 can be fixed to the margins 18 and 19 of the film 12 by means of free edge zones of the strip 28.

Figure 8B:
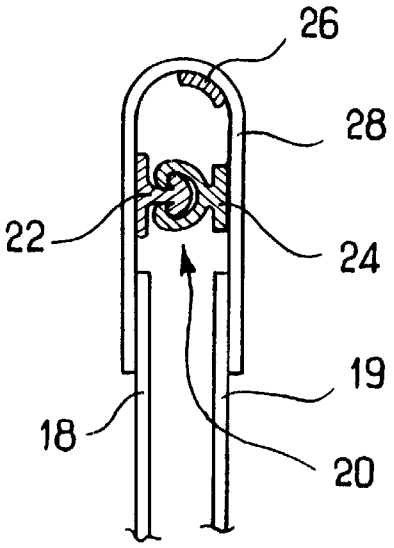

More precisely, in FIG. 8*b*, the strip 28 is fixed by means of its own longitudinal margins to the outside surfaces of the margins 18 and 19 of the film 12. Nevertheless, in another variant, the strip 28 could be fixed by means of its own longitudinal margins to the inside surfaces of the margins 18 and 19 of the film 12.

Under such circumstances, the looped closure assembly formed in this way can be sealed vertically to a margin of the film 12, like a fold.

Figure 9:
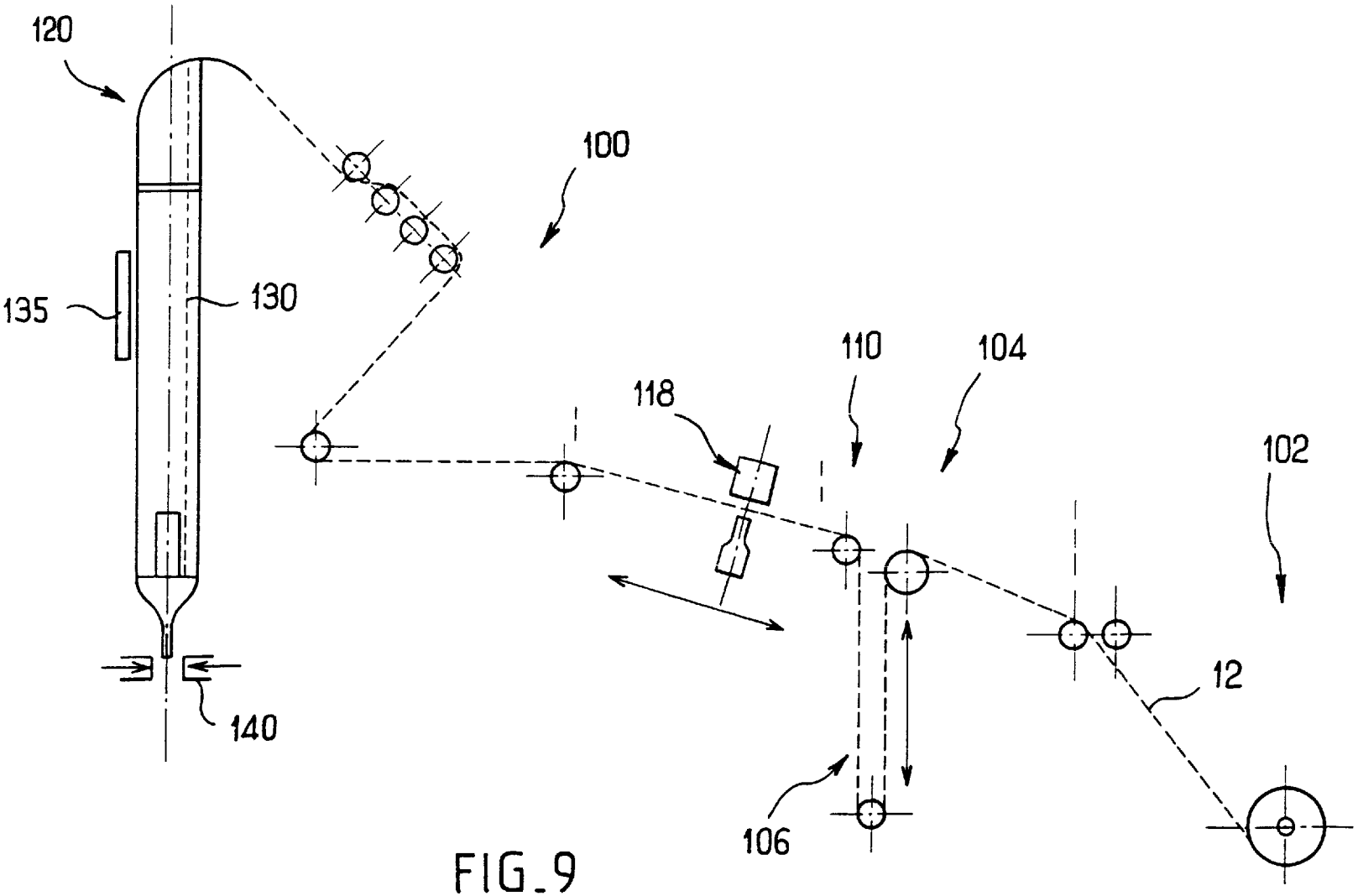
FIG. 9 is a diagrammatic side view of an automatic forming, filling, and closing machine of the present invention.
Figure 10:
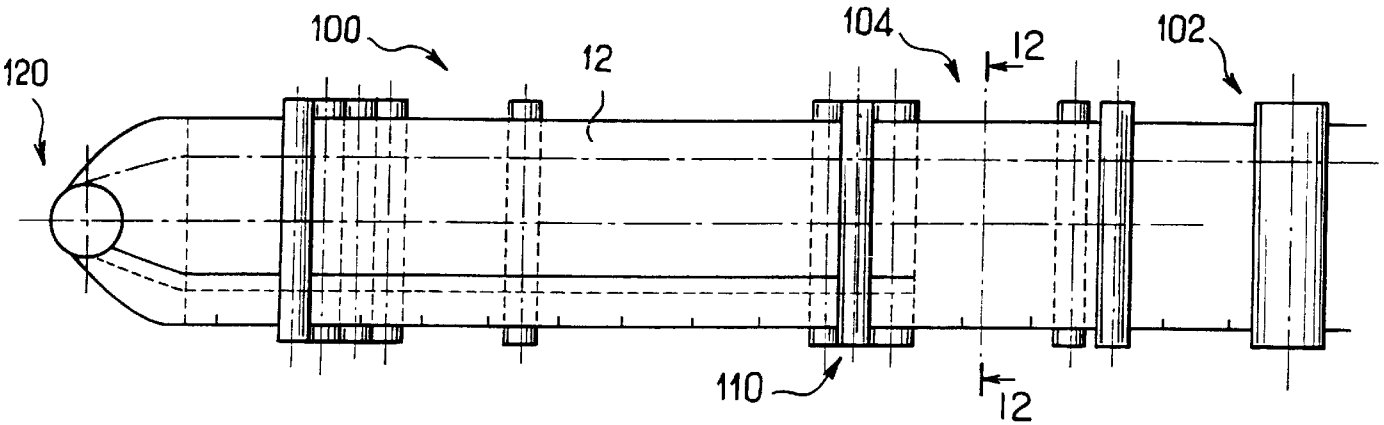
FIG. 10 is a plan view of the machine of FIG. 9.

FIGS. 9 and 10 show the general structure of a machine 100 in accordance with the present invention.

Figure 12:
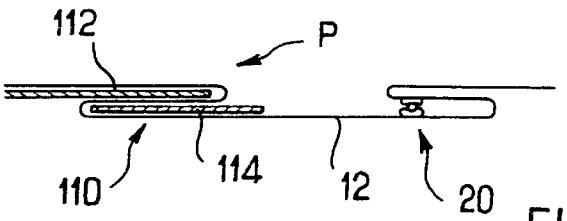
FIG. 12 is a diagrammatic vertical section view taken along line 12—12 of FIG. 10 of baffle-forming means used for making a longitudinal fold in the context of the present invention.
Figure 11:
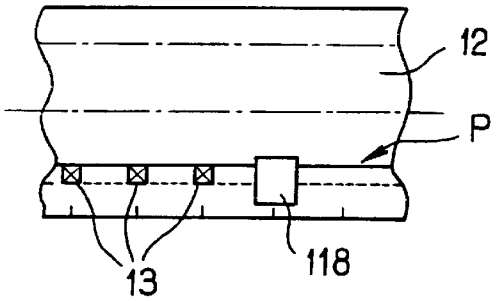
FIG. 11 is a plan view showing a detail of means for localized heat sealing of a longitudinal fold, in an application of the present invention.
Figure 13:
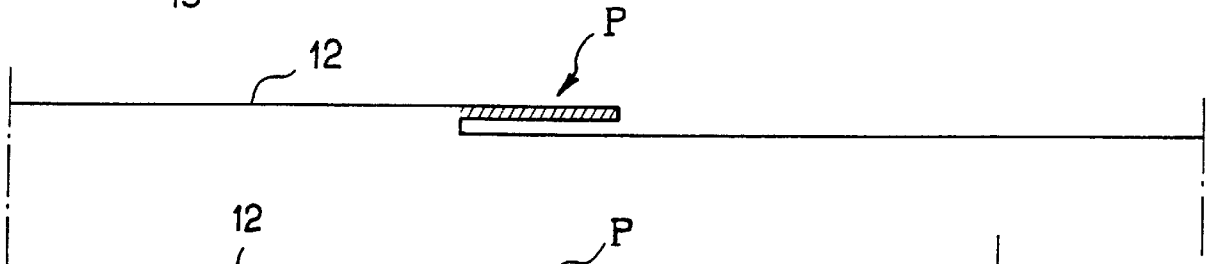
FIG. 13 is a diagrammatic vertical section view of a longitudinal fold in accordance with the invention.

These figures show a pay-out portion 102 followed by a drive portion 104 that includes a jumper roller 106 whose height varies. The gusset 40 is prepared in this portion 104 by means of a baffle 110 constituted by two overlapping and superposed plates 112 and 114. The baffle 110 defines a Z-shaped fold P, as can be seen in FIG. 12.

Also, as mentioned above, according to the present invention, the machine 100 includes fixing means 118 suitable, prior to the bags being formed, for defining localized zones 13 for securing the above-mentioned fold at locations corresponding to the transverse sealing lines which are made subsequently.

These fixing means 118 are preferably provided at the portion 104 or at the portion of the machine 100 that is situated immediately downstream therefrom.

They can be implemented in various ways. In a preferred embodiment, they are designed to heat-seal spots in the fold P in order to hold it together. However, in other variants, the means may be designed to fix the fold by static discharge, by spots of adhesive, or by any other equivalent fixing means.

The above-mentioned fixing means 118 are preferably adjustable along the length of the film 12 so as to make it possible to accurately adjust the positioning of the fixing means relative to the zones that subsequently correspond to the transverse sealing lines.

Naturally, it is also necessary to synchronize with care the instants at which the fixing means 118 are caused to operate relative to travel of the film 12, since the instants at which the fixing means 118 operate determine both the locations of the zones 13, and the pitch between the zones.

As mentioned above, securing the fold P in a localized manner immediately after it has been formed enables the fold to be held together all along its travel path. This thus constitutes an essential characteristic of the present invention. It should also be observed that since the fold is secured at locations corresponding to the transverse sealing lines, the zones 13 do not interfere in any way with subsequent fabrication of the bag.

Also, localized securing of the fold P facilitates subsequent formation of the transverse sealing lines, given the extra thickness at such locations that results from the fold that is to form the gusset.

The film 12 provided with the fold P is then conveyed in a conventional manner to the FFS machine proper which comprises a former 120, a filling chute 130, longitudinal heat-sealing means 135, and transverse heat-sealing means 140.

More precisely, in the context of the present invention, the fixing means 118 serve to secure two of the walls of the fold P together when the film 12 a composite, and three portions thereof when the film 12 is simple.

Figure 14:
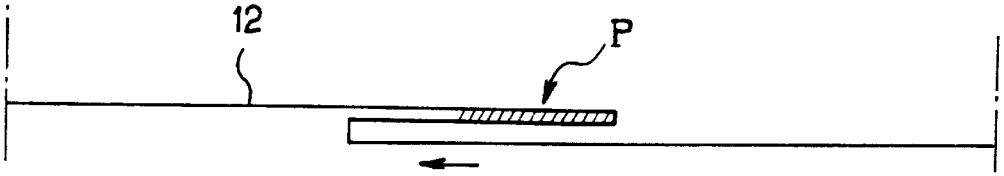
FIG. 14 is a diagram showing the risk of slippage along the longitudinal fold, which risk is remedied by means of the present invention.
Figure 17:
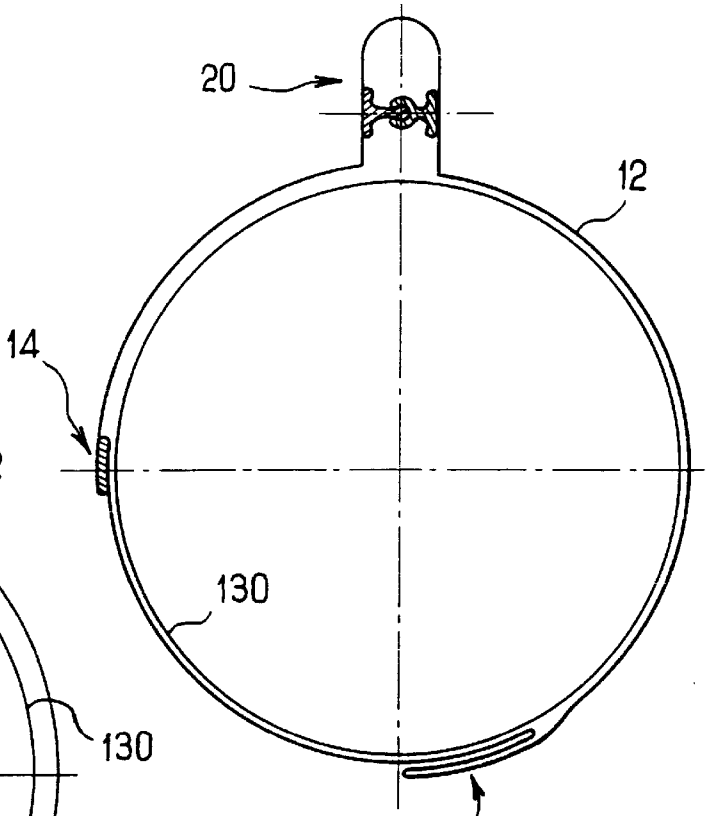
FIGS. 16 and 17 are horizontal section views through the filling chute of the machine of the present invention showing the way in which it is possible to make bags having gussets of different depths on the same filler chute.
Figure 16:
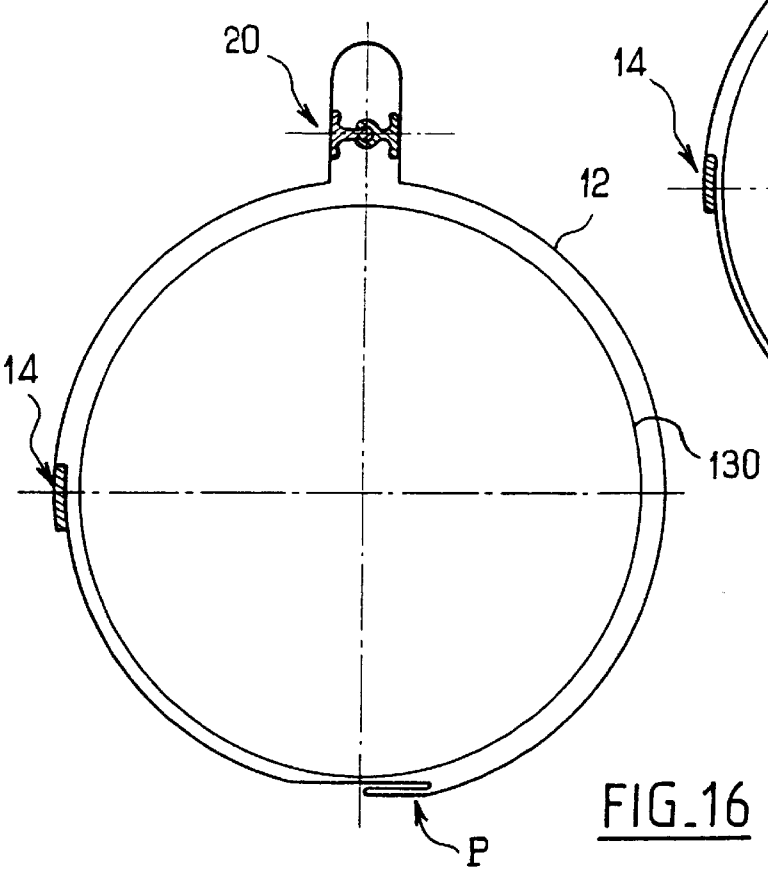

The fold P formed upon leaving the pay-out means 102 of the machine 100 is thus subsequently held together as the film travels. For a composite film, only two portions of the fold P are generally fixed together so there is a risk of the fold P slipping laterally, as shown in FIG. 14. To remedy this difficulty, it is preferable in the context of the present invention to provide a system for guiding the walls of the film 12 by wheels having axles movable under suitable control means and/or any other system for guiding the edges of the film.

The final fold P is preferably formed while the film 12 is being taken off, firstly adjacent to the ribs 22 and 24, and secondly adjacent to the fold P, by means of a set of pneumatic, hydraulic, electromagnetic, or mechanical clamps 150 which pinch and stretch the film 12 while transverse heat-sealing is taking place.

Such clamps 150 are consequently sequentially controlled so as to open and close firstly to take hold of the film 12 and secondly to move laterally in order to apply a certain amount of tension to the film 12 and avoid any unwanted folding.

Figure 15:
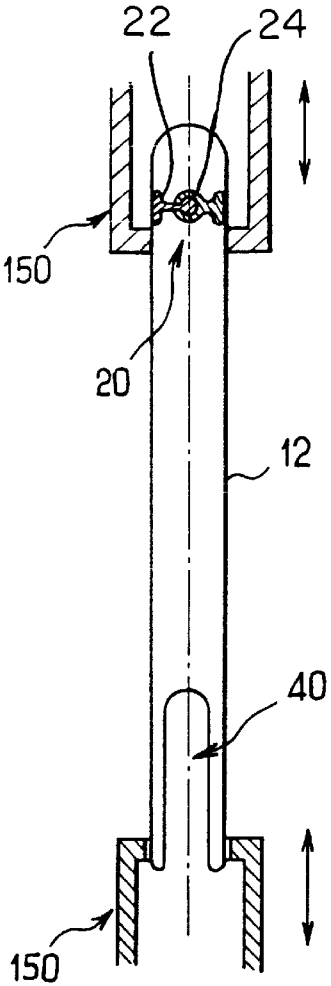
FIG. 15 is a diagrammatic horizontal section view of the means for stretching in accordance with the present invention, prior to making the transverse sealing lines.
Figure 19:
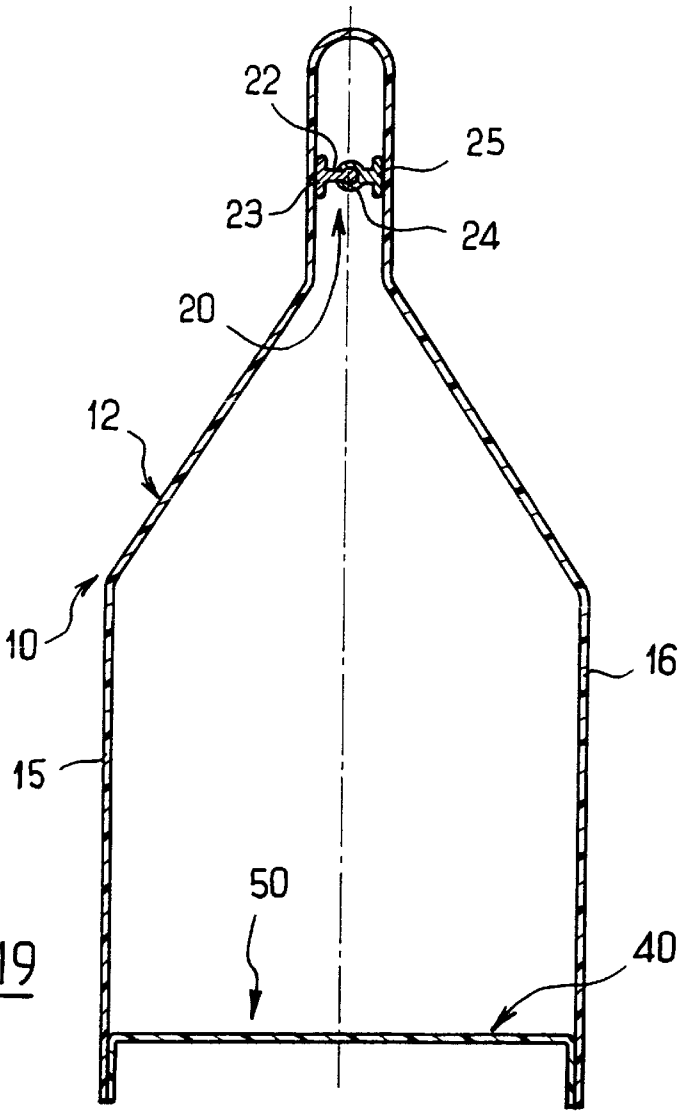
FIGS. 18 and 19 are diagrammatic cross-section views of two variant embodiments of bags of the present invention having gussets of different depths, and made by adding a folded strip to a film.
Figure 18:
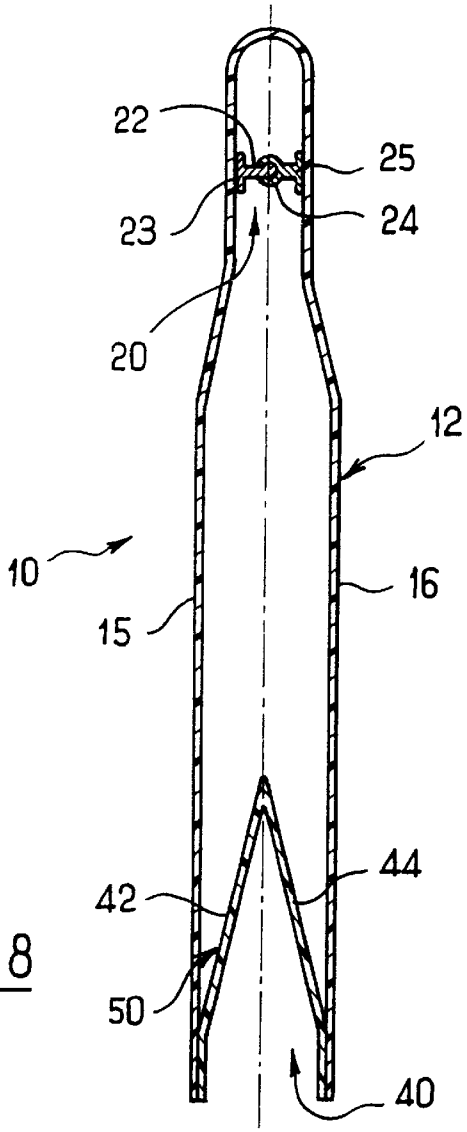

Such a clamp system is shown diagrammatically in FIG. 15.

The fold P can be positioned on one side or the other of the axis of the tube 130 relative to its longitudinal sealing line 14.

It should be observed that the present invention makes it possible to use a single filler tube 130 and a single former 120, which are expensive parts of an FFS machine, in association with different depths of fold P, and thus of gusset 40, merely by altering the area of overlap between the plates 112 and 114 constituting the shaping baffle 110.

Thus, FIGS. 3 to 6, 16, and 17 show gussets of various depths.

Figure 22:
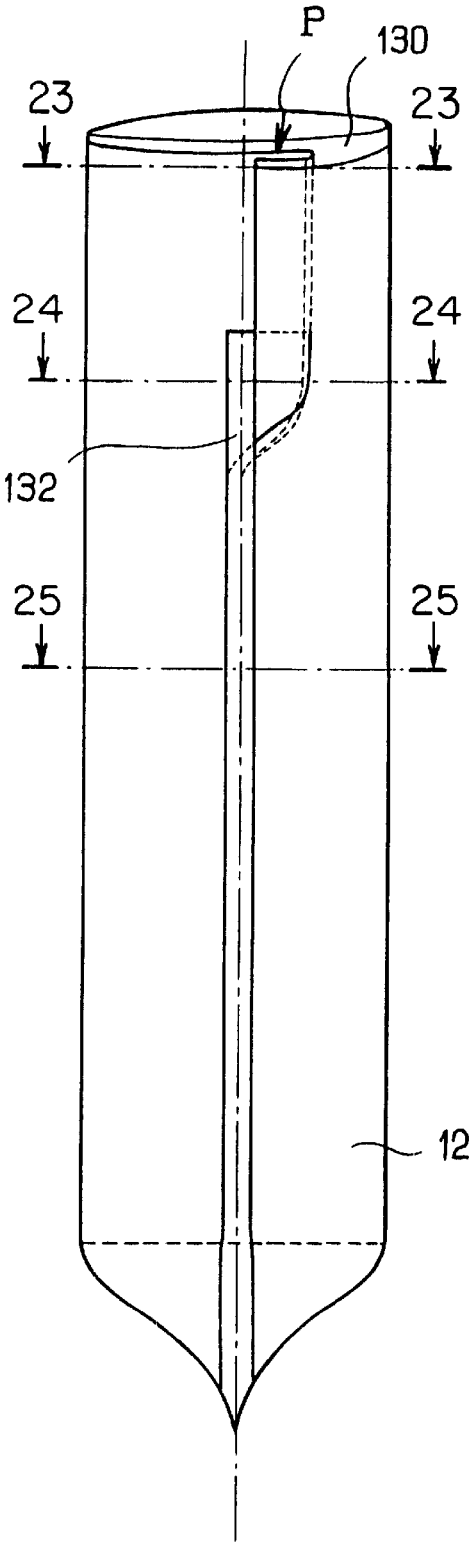
FIG. 22 is a diagrammatic side view of the filler chute in accordance with the present invention.
Figure 23:
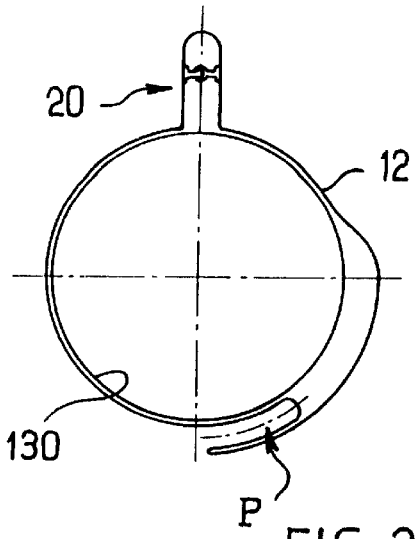
FIGS. 23, 24, and 25 are three horizontal section views through the filler chute of FIG. 22 as taken on planes 23—23, 24—24, and 25—25 of FIG. 22.
Figure 24:
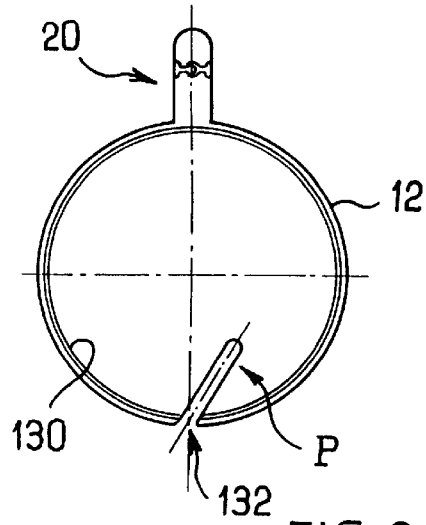
Figure 25:
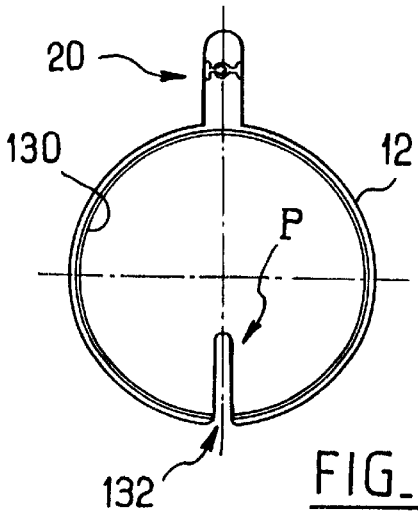

In another variant, the fold P can be finalized by being forced into the filler tube 130. For this purpose, it suffices to split the former longitudinally to form an inlet window 132 for the fold P which is situated at an appropriate height (see FIG. 22).

Such a window 132 and the corresponding shaping technique are shown in particular in FIGS. 22 to 25.

In the above embodiments, the gusset 40 is formed by making a Z-shaped fold in the film 12.

However, in a variant shown in FIGS. 2 and 18 to 21, the gusset 40 can be implemented by adding a strip 50 of film in the vicinity of the former 120. This strip 50 is fixed to the film 12 by any conventional technique, and preferably by heat-sealing.

This technique makes it possible to add a strip 50 of composite or simple film to a composite or simple film 12 fitted with a closure assembly 20 before it passes through the former 120, and the strip 50 then forms the bottom gusset 40 by means of longitudinal heat-sealing.

It should also be observed that the transverse sealing line 30 may be straight or curved so as to help make a bag freestanding in a vertical position after the gusset 40 has become deployed. More precisely, under such circumstances, the transverse sealing lines of sealing 30 made on the two sides of the bag are symmetrical. To implement such curved transverse sealing lines of sealing 30, it suffices to shape the transverse heat-sealing jaws 140 accordingly.

The strip 50 that is to form the gusset 40 can be prefolded or it can be folded in the machine. It is likewise pre-fixed in steps at zones 13 corresponding to the transverse sealing lines 30, as mentioned above.

Here again, the size of the final gusset 40 depends on the width of the strip 50 used.

Naturally, the present invention is not limited to the embodiments described above, but extends to any variant coming within the spirit of the invention.

In particular, it will be observed that the film 12 can be provided with the closure assembly 20 before the fold P is made (with the closure assembly 20 being formed originally in the film 12 or being added thereto) or the closure assembly 20 can be fitted to the film immediately upstream from the former 120.

Also, and in a conventional manner, the advance of the film 20 can be driven and synchronized as a function of the operation of the heat-sealing jaws 135, 140, or it can advance continuously.

In yet another variant, it should be observed that with an add-on bottom gusset 40, the color of the gusset can be different from that of the body of the bag.

Also, in the context of the present invention, the transverse sealing lines 30 may be made either to bond together the two walls 42 and 44 of the bottom gusset 40 at the transverse lines of sealing, or else to avoid bonding them together in this way.

Figure 26:
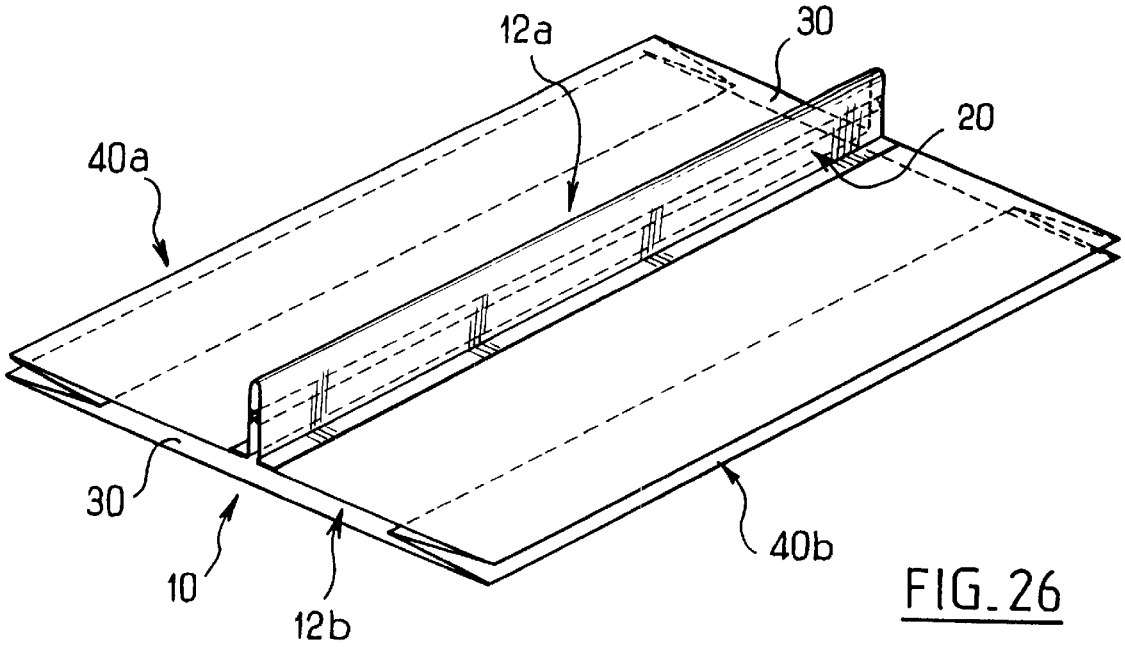
FIGS. 26 and 27 show two variant embodiments of bags having pairs of gussets.

By way of example, FIG. 26 shows an embodiment in which the bag 10 has two longitudinal gussets 40*a* and 40*b* that are parallel to the closure ribs 20. More precisely, in FIG. 26, the two gussets 40*a* and 40*b* are equidistant from the closure assembly 20. Nevertheless, such equal distances are not absolutely necessary.

To make the two gussets 40*a* and 40*b*, it suffices to make two folds P in the film 12 prior to conveying it to the former 120, or to apply two strips 50 for this purpose, in which case the bag is made not from a single film 12, but from two overlying sheets 12*a* and 12*b*.

Figure 27:
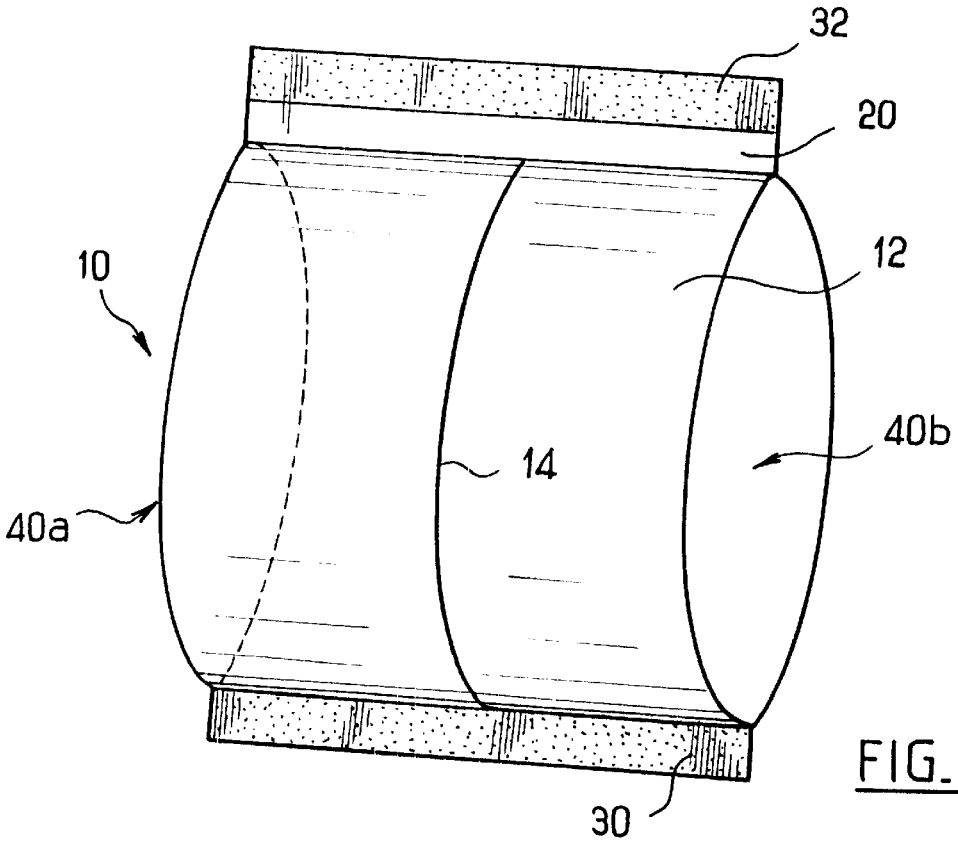

FIG. 27 shows a variant embodiment of a bag 10 that has two lateral gussets 40*a* and 40*b* extending perpendicularly to the closure assembly 20. These lateral gussets 40*a* and 40*b* are likewise obtained by means of longitudinal folds formed in the film 12 before it reaches the former 120, or by adding appropriate strips 50 to the film 12, as described above. In this case, means are provided to place the closure assembly 20 on the film 12 transversely to the travel direction of the film. Such means for conveying the closure assembly 20 in a transverse direction can be in compliance, for example, with the means described in the following patent documents: U.S. Pat. No. 4,617,683, U.S. Pat. No. 4,655,862, U.S. Pat. No. 4,666,536, U.S. Pat. No. 4,701,361, U.S. Pat. No. 4,709,398, U.S. Pat. No. 4,878,987, U.S. Pat. No. 4,844,759, U.S. Pat. No. 4,929,225, U.S. Pat. No. 4,909,017; and U.S. Pat. No. 5,111,643. In FIG. 27, reference 14 designates the longitudinal sealing line between the free edges of the film 12, while references 30 and 32 designate the transverse sealing lines of sealing that finish the bags 10. It will be observed that the closure assembly 20 is advantageously adjacent to one of the transverse lines of 32 to guarantee that the bags are leakproof in spite of the presence of the lateral gussets 40*a* and 40*b*.

Where appropriate, it is possible to envisage making the fold(s) 40 upstream or downstream from the former 120.

In other variant embodiments, the fold 40 that is to form the gusset can be a transverse fold, that is a fold extending perpendicularly to the travel direction of the film 12.

Under such circumstances, it is also possible to provide for the fold 40 being implemented in the form of a Z-shaped fold extending transversely in the body of the film 12.

However, it is preferable for a transverse fold 40 to be made by means of a strip 50 that is itself folded longitudinally into a U-shape and that is added to the film 12.

Figure 20:
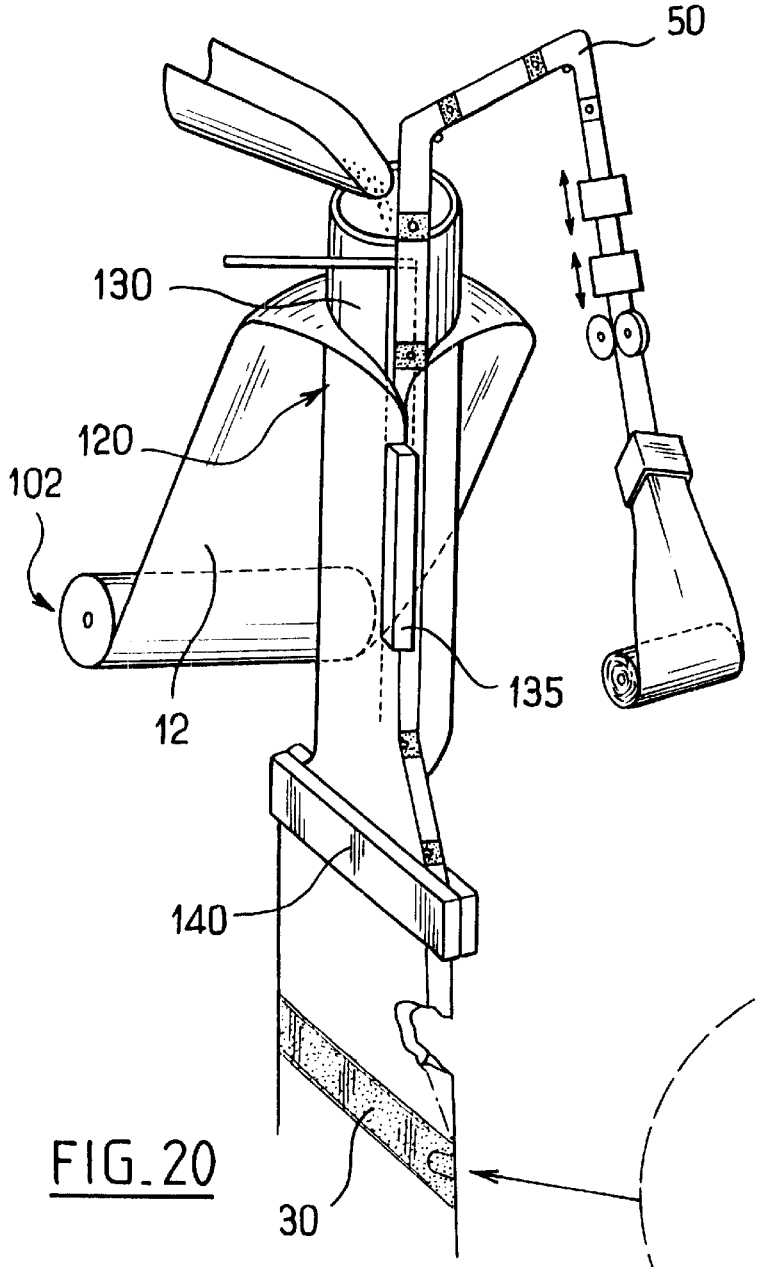
FIG. 20 is a diagrammatic perspective view of a variant machine of the present invention that operates by adding a folded strip to make the gusset.
Figure 21:
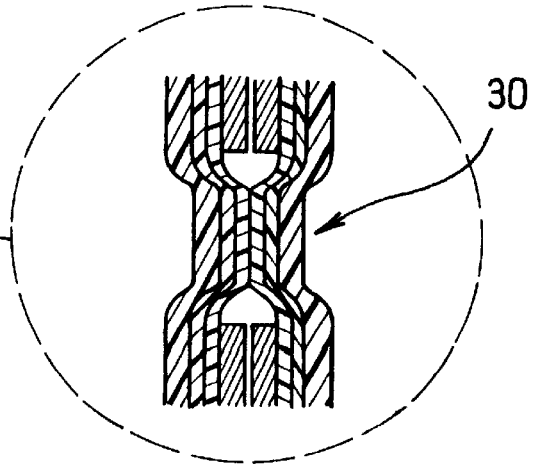
FIG. 21 is a detail view at a transverse sealing line.
Figure 28:
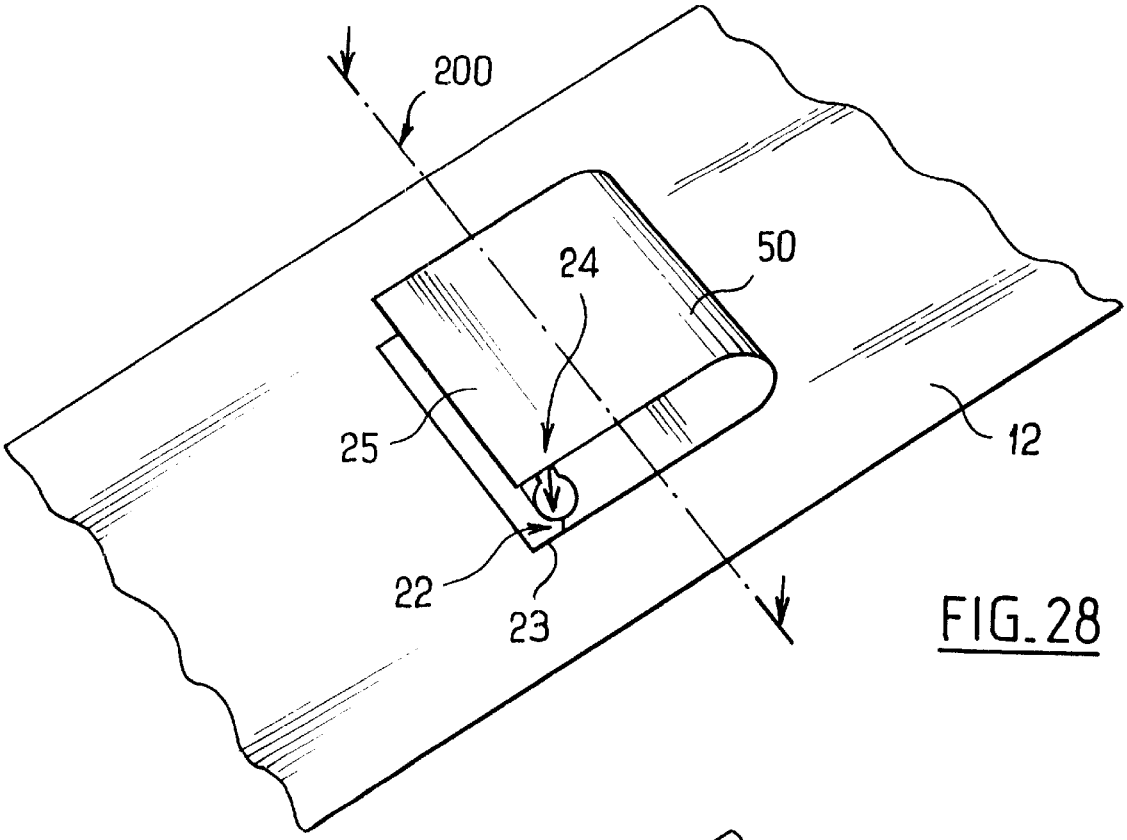
FIGS. 28 and 29 show two variants of ribs and strips disposed transversely on a film to form bottom gussets in the bags.

FIG. 28 shows such a U-shaped strip 50 with its convex side directed rearwards relative to the travel direction of the film 12, which strip 50 is initially connected or integrally formed with the support strips 23, 25 of the ribs 22, 24. The strip 50 connected to the ribs 22, 24 and placed on the film 12 is of a length equal to half the width of the film 12. One side of the U-shaped strip 50 plus the adjacent support strip 23 is heat-sealed to the film 12 at a station upstream from the former 120. The other side of the U-shaped strip 50 plus the second support strip 25 is heat-sealed to the inside wall of the film 12 constituting the package after the film 12 has been folded into the tubular configuration and the package has been filled, that is while the package is being finished, at a station for performing transverse heat-sealing 140 as seen in FIG. 20.

Such a strip 50 connected to the ribs 22, 24 may be conveyed transversely relative to the film 12 by means known for this purpose and as described in the above-mentioned patent documents.

Naturally, it is necessary to provide the transverse heat-sealing station 140 with means suitable for cutting the strip 50 so as to separate the U-shaped strip 50 proper, that is, to form a gusset, from the ribs 22 and 24 along a cut line referenced 200 in FIG. 28. Thus, after cutting along the line 200, the ribs 22 and 24 are connected to the mouth zone of a bag 10 that has just been individualized, while the U-shaped strip 50 forms a gusset for the bottom of the bag 10 that is being made.

The opposite configuration is also possible, that is the assembly constituting the U-shaped strip 50 and the ribs 22 and 24 can be put into place with the convex side of the U-shaped strip 50 at the front relative to the travel direction.

Figure 29:
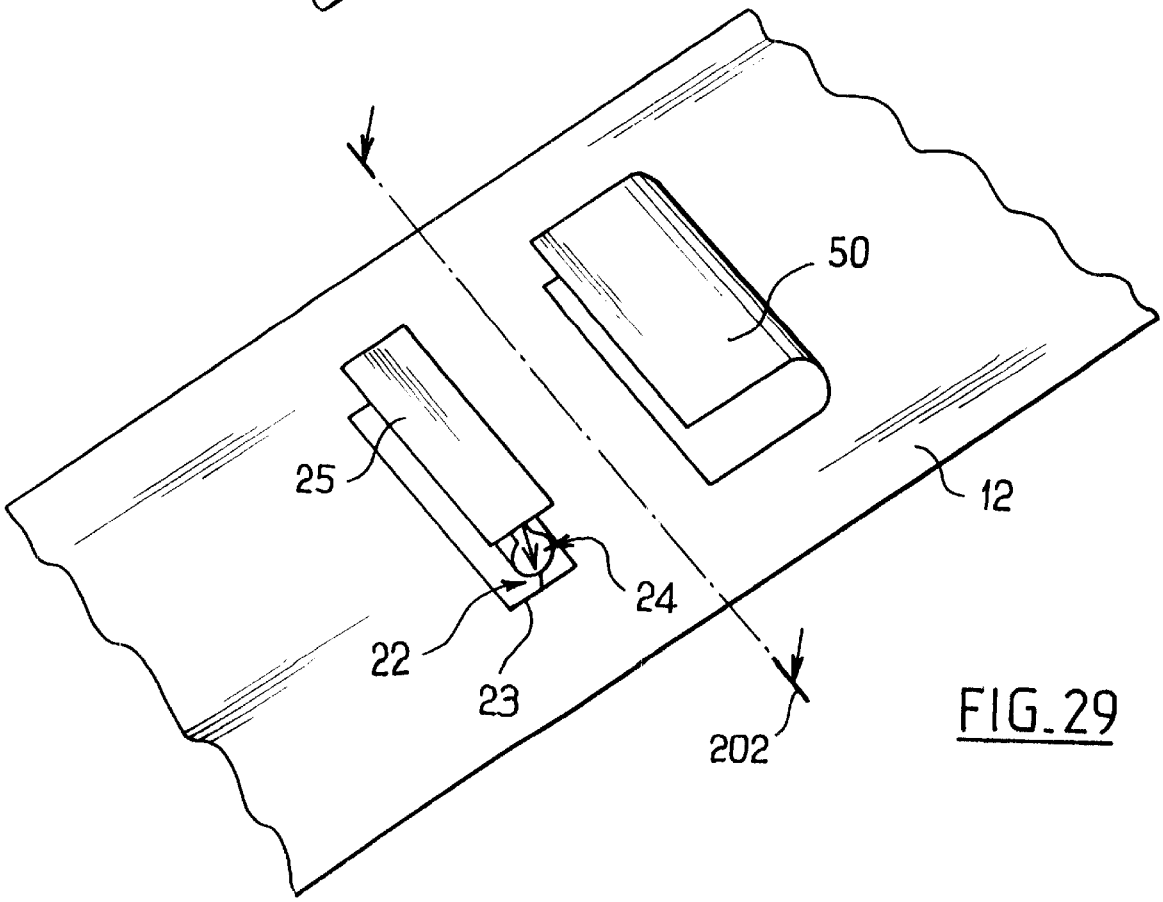

In another variant shown diagrammatically in FIG. 29, such a U-shaped transverse strip 50 placed on the film 12 can be initially separated from the transverse closure ribs 22 and 24. This avoids the subsequent operation of cutting the strip 50 as described with reference to FIG. 28. Nevertheless, it is still necessary to separate bags in a conventional manner along the line 202 between the closure ribs 22 and 24 and the strip 50.

When using a transverse U-shaped strip 50, the operation of transversely heat-sealing the strip 50 to the film 12 can be adapted either to fix together the ends of the strip by means of the inside surfaces of the folds, in a manner comparable to FIG. 27, or else to allow the inside surfaces of the fold to remain free, in a manner comparable to FIG. 26.

In addition, in the context of implementing a transverse fold, it is possible in a manner comparable to implementing a longitudinal fold, to form a single fold that preferably forms the bottom gusset of a bag or multiple folds that form lateral gussets, in association with closure ribs that can either be parallel or else perpendicular to the fold or folds.

Obviously, many modifications and variations of the present invention are possible in light of the above teachings. It is therefore to be understood that within the scope of the appended claims, the present invention may be practiced otherwise than as specifically described herein.

I claim:

1. Apparatus for automatically forming, filling, and sealing bags made from a flexible film provided with complementary closure ribs, comprising:

tubular means for forming flexible film material, having oppositely disposed longitudinally extending edges, into a tubular bag by bringing said oppositely disposed longitudinally extending edges together;

means for conveying a single sheet of flexible film material from a supply of flexible film material to said tubular forming means for formation of said tubular bag within said tubular forming means;

means for enabling filling of said tubular bag with a product to be introduced into and contained within said bag;

means for sealing said bag, including said longitudinally extending edges of said flexible film material, so as to retain a product, introduced into said bag, within said bag; and means for forming at least one fold within said single sheet of flexible film material, at a location which is upstream of said tubular forming means and which is interposed between said supply of flexible film material and said tubular forming means, and prior to said forming of said single sheet of flexible film material into said tubular bag within said tubular forming means, so as to provide at least one gusset within said bag when said single sheet of flexible film material is formed into said tubular bag by said tubular forming means.

2. Apparatus according to claim 1, wherein the fold is longitudinal, parallel to the travel direction of the film.

3. Apparatus according to claim 1, wherein the fold is transverse, perpendicular to the travel direction of the film.

4. Apparatus according to claim 1, including means for conveying closure ribs longitudinally, parallel to the travel direction of the film.

5. Apparatus according to claim 1, including means for conveying closure ribs transversely, perpendicularly to the travel direction of the film.

6. Apparatus according to claim 1, including fixing means for defining localized zones for securing the fold.

7. Apparatus according to claim 6, wherein:

said fixing means defining said localized zones for securing said at least one fold are adapted to define said zones, prior to said bags being made, at locations that correspond to transverse sealing lines.

8. Apparatus according to claim 1, wherein:

said means for forming said at least one gusset forms said at least one gusset such that said least one gusset is disposed parallel to a closure assembly comprising said complementary closure ribs.

9. Apparatus according to claim 1, wherein:

said means for forming said at least one gusset forms said at least one gusset such that said at least one gusset is disposed perpendicular to a closure assembly comprising said complementary closure ribs.

10. Apparatus according to claim 1, wherein:

said means for forming said at least one gusset comprises means for forming at least two parallel gussets within said bag.

11. Apparatus according to claim 1, wherein the fold is made in the form of a Z-shaped fold in the body of the film.

12. Apparatus according to claim 1, wherein:

said tubular forming means comprises a former fed with said single sheet of flexible film material in a planar state from said supply of flexible film material and forming said single sheet of flexible film material into a tube;

said means for enabling filling of said tubular bag comprises a filling chute operatively connected to said tube so as to fill said tube with a product to be packaged within said bag; and said sealing means comprises longitudinal heat-sealing means for closing said tube longitudinally by heat-sealing said longitudinally extending edges of said flexible film material together, and means for sequentially generating a first transverse heat-sealed line before a product is deposited within said tube by means of said filling chute, and a second transverse heat-sealed line when the product has been deposited within said tube so as to thereby close said package bag around the product.

13. Apparatus according to claim 12, further comprising:

means for forming at least one additional fold within said flexible film material after said flexible film material has been brought to said former.

14. Apparatus according to claim 1, wherein the gusset is made up of two facets which form a tuck inside the bag, having a concave face looking outwards.

15. Apparatus according to claim 12, wherein:

said film is prefitted with said closure ribs at a position upstream of said former.

16. Apparatus according to claim 1, wherein the ribs are integrally molded with the film.

17. Apparatus according to claim 1, wherein the ribs are added to the film.

18. Apparatus according to claim 17, further including means suitable for fixing the ribs to the film.

19. Apparatus according to claim 17, wherein the ribs are carried by respective strips fixed to the inside surface of the film.

20. Apparatus according to claim 17, wherein the ribs are carried by a single strip that is folded into a U-shape and fixed to the inside surface of the film.

21. Apparatus according to claim 20, wherein the U-shaped strip carrying the ribs is heat-sealed to the free margins of the film in zones situated between the ribs and the center of the strip such that the pressure inside the bag does not stress the ribs opening in the direction.

22. Apparatus according to claim 20, wherein the U-shaped strip carrying the ribs is heat-sealed across its width to the margins of the film to form an outer first sheet including the web of the U-shaped strip, and an inner second sheet including the ribs, the inner, second sheet being longer in dimension than the outer sheet so that the pressure inside the bag does not stress the ribs in the opening direction.

23. Apparatus according to claim 1, wherein:

said film is selected from a group comprising a simple single-layer flexible film and a composite film made up of a plurality of adjacent layers formed by coextrusion.

24. Apparatus according to claim 1, including a baffle formed by two overlapping superposed plates for forming the fold which is Z-shaped.

25. Apparatus according to claim 24, including means for modifying the overlap of the plates.

26. Apparatus according to claim 6, wherein:

said fixing means comprises means selected from the group comprising heat-sealing, static discharge, and adhesive means.

27. Apparatus according to claim 6, wherein the fixing means are adjustable along the length of the film.

28. Apparatus according to claim 1, further comprising:

means for guiding wall portions of said film comprising wheels having axles movable by control means.

29. Apparatus according to claim 12, further comprising:

clamping means, selected from the group of pneumatic, hydraulic, electromagnetic, and mechanical clamps, for pinching and stretching said film while said transverse heat-sealing is taking place.

30. Apparatus according to claim 12, wherein the fold is finalized by being forced into the filling chute.

31. Apparatus according to claim 32, wherein the former and the filling chute includes a window for receiving the fold.

32. Apparatus according to claim 13, wherein the transverse sealing lines are curved to make the bag more suitable for freestanding in a vertical position after the gusset has been deployed.

33. Apparatus according to claim 1, wherein:

the ends of said fold are fixed along the inside surfaces thereof.

34. Apparatus according to claim 1, wherein:

the ends of said fold are free at the inside surfaces thereof.

35. Apparatus according to claim 19, further comprising:

means for transversely conveying a U-shaped strip integrally molded with said respective support strips for said closure ribs;

means for fixing said U-shaped strip and said support strips to said film; and means for subsequently forming a cut line between said U-shaped strip and said strips supporting said ribs.

36. Apparatus according to claim 12, including means for conveying a U-shaped strip transversely and for fixing said strip to the film.

37. Apparatus according to claim 36, wherein:

a first branch of said U-shaped strip is fixed to said film before said film is formed into said tube; and a second branch of said strip is fixed to said film during said bag-closing around said product.

38. Apparatus according to claim 35, wherein the U-shaped strip is of a length equal to half the width of the film.

39. A method of manufacturing bags from a flexible film provided with complementary closure ribs, by using an automatic forming, filling, and sealing machine, comprising the steps of:

providing a tubular means for forming flexible film material, having oppositely disposed longitudinally extending edges, into a tubular bag by bringing said oppositely disposed longitudinally extending edges together;

conveying a single sheet of flexible film material from a supply of flexible film material to said tubular forming means so as to permit said tubular forming means to form a tubular bag by bringing said oppositely disposed longitudinally extending edges together;

providing a means for enabling filling of said tubular bag with a product to be introduced into and contained within said bag;

providing a means for sealing said tubular bag, including said longitudinally extending edges of said flexible film material, so as to retain a product, introduced into said tubular bag, within said tubular bag; and forming at least one fold within said single sheet of flexible film material, at a location which is upstream of said tubular forming means and which is interposed between said supply of flexible film material and said tubular forming means, and prior to said forming of said single sheet of flexible film material into said tubular bag within said tubular forming means, so as to provide at least one gusset within said tubular bag when said single sheet of flexible film material is formed into said tubular bag by said tubular forming means.

40. A method according to claim 39, including the step of defining localized zones securing said fold.

41. A method according to claim 40, wherein the locations at which the fold is secured correspond to the locations of subsequent transverse sealing lines.

42. A method according to claim 39, wherein the step of forming the fold consists in forming a Z-shaped fold in the body of the film.

43. A method according to claim 39, further including a step consisting in conveying lengths of closure ribs onto the film transversely to the travel direction thereof.

44. A method according to claim 39, further comprising the steps of:

conveying a U-shaped strip transversely, wherein said strip is integrally formed with support strips for said closure ribs;

fixing said U-shaped strip and said support strips to said film; and subsequently forming a cut line between said U-shaped strip and said strips supporting said ribs.

45. A method according to claim 44, wherein a first branch of the U-shaped strip is fixed to the film before it is formed into said tubular bag, while the second branch of said strip is fixed to the film during the bag sealing step.

46. Apparatus for automatically forming, filling, and sealing bags made from a flexible film provided with complementary closure ribs, comprising:

tubular means for forming flexible film material, having oppositely disposed longitudinally extending edges, into a tubular bag by bringing said oppositely disposed longitudinally extending edges together;

means for conveying at least one sheet of flexible film material from a supply of flexible film material to said tubular forming means for formation of said tubular bag within said tubular forming means;

means for enabling filling of said tubular bag with a product to be introduced into and contained within said bag;

means for sealing said bag, including said longitudinally extending edges of said flexible film material, so as to retain a product, introduced into said bag, within said bag; and means for adding at least one folded strip of material, separate from said at least one sheet of flexible film material, to said at least one sheet of flexible film material, so as to provide at least one gusset within said bag when said at least one sheet of flexible film material is formed into said tubular bag by said tubular forming means.

47. The apparatus as set forth in claim 46, wherein:

said at least one folded strip comprises a pair of folded strips wherein said tubular bag will have a pair of gussets formed therein.

48. The apparatus as set forth in claim 46, wherein:

said at least one sheet of flexible film material comprises a single folded sheet of flexible film material with said at least one folded strip comprising said gusset interconnecting together said longitudinally extending edges of said single folded sheet of flexible film material.

49. The apparatus as set forth in claim 47, wherein:

said at least one sheet of flexible film material comprises a pair of sheets of flexible film material with said pair of folded gusset strips interposed between said longitudinally extending edges of said pair of sheets of flexible film material.

50. The apparatus as set forth in claim 46, wherein:

said means for adding said at least one folded gusset strip, to said at least one sheet of flexible film material, adds said at least one folded gusset strip to said at least one sheet of flexible film material at a location which is upstream of said tubular bag forming means.

51. The apparatus as set forth in claim 46, wherein:

said means for adding said at least one folded gusset strip, to said at least one sheet of flexible film material, adds said at least one folded gusset strip to said at least one sheet of flexible film material as said tubular bag forming means is forming said at least one sheet of flexible film material into said tubular bag.

52. A method of manufacturing bags from a flexible film provided with complementary closure ribs, by using an automatic forming, filling, and sealing machine, comprising the steps of:

providing a tubular means for forming flexible film material, having oppositely disposed longitudinally extending edges, into a tubular bag by bringing said oppositely disposed longitudinally extending edges together;

conveying at least one sheet of flexible film material from a supply of flexible film material to said tubular forming means so as to permit said tubular forming means to form a tubular bag by bringing said oppositely disposed longitudinally extending edges together;

providing a means for enabling filling of said tubular bag with a product to be introduced into and contained within said bag;

providing a means for sealing said tubular bag, including said longitudinally extending edges of said flexible film material, so as to retain a product, introduced into said tubular bag, within said tubular bag; and adding at least one folded strip of material, separate from said at least one sheet of flexible film material, to said at least one sheet of flexible film material, so as to provide at least one gusset within said tubular bag when said at least one sheet of flexible film material is formed into said tubular bag by said tubular forming means.

53. The method as set forth in claim 52, wherein:

said at least one folded strip of material comprises a pair of folded strips wherein said tubular bag will have a pair of gussets formed therein.

54. The method as set forth in claim 53, wherein:

said at least one sheet of flexible film material comprises a pair of sheets of flexible film material with said pair of folded gusset strips interposed between said longitudinally extending edges of said pair of sheets of flexible film material.

55. The method as set forth in claim 52, wherein:

said at least one sheet of flexible film material comprises a single folded sheet of flexible film material with said at least one folded strip comprising said gusset interconnecting together said longitudinally extending edges of said single folded sheet of flexible film material.

56. The method as set forth in claim 52, wherein:

said at least one folded gusset strip, to be added to said at least one sheet of flexible film material, is added to said at least one sheet of flexible film material at a location which is upstream of said tubular bag forming means.

57. The method as set forth in claim 52, wherein:

said at least one folded gusset strip, to be added to said at least one sheet of flexible film material, is added to said at least one sheet of flexible film material as said tubular forming means is forming said at least one sheet of flexible film material into said tubular bag.

58. Apparatus according to claim 46, wherein the attached gusset is of a color that is different from that of the body of the bag.

* * * * *